US010991320B2

(12) United States Patent
Kim et al.

(10) Patent No.: US 10,991,320 B2
(45) Date of Patent: Apr. 27, 2021

(54) ADAPTIVE SYNCHRONIZATION

(71) Applicant: Facebook Technologies, LLC, Menlo Park, CA (US)

(72) Inventors: Cheonhong Kim, Mountain View, CA (US); Min Hyuk Choi, San Jose, CA (US); Rui Zhang, Sunnyvale, CA (US); Samuel Gosselin, San Francisco, CA (US)

(73) Assignee: Facebook Technologies, LLC, Menlo Park, CA (US)

( * ) Notice: Subject to any disclaimer, the term of this patent is extended or adjusted under 35 U.S.C. 154(b) by 0 days.

(21) Appl. No.: 16/544,952

(22) Filed: Aug. 20, 2019

(65) Prior Publication Data

US 2020/0394971 A1 Dec. 17, 2020

Related U.S. Application Data

(60) Provisional application No. 62/860,444, filed on Jun. 12, 2019.

(51) Int. Cl.
*G09G 3/34* (2006.01)
*G09G 3/36* (2006.01)

(52) U.S. Cl.
CPC ..... *G09G 3/3406* (2013.01); *G09G 3/36* (2013.01)

(58) Field of Classification Search
CPC ..... G09G 3/36; G09G 3/3406
See application file for complete search history.

(56) References Cited

U.S. PATENT DOCUMENTS

2008/0079705 A1* 4/2008 Yang ..... G09G 3/3413 345/207
2009/0091528 A1* 4/2009 Hong ..... G09G 3/3406 345/102
2011/0279041 A1* 11/2011 Dai ..... G09G 3/3406 315/152
2011/0292022 A1* 12/2011 Lee ..... G09G 3/20 345/212
2012/0068978 A1* 3/2012 Aitken ..... G09G 3/3406 345/207
2012/0194493 A1* 8/2012 Soto ..... G02F 1/133603 345/207
2013/0328842 A1* 12/2013 Barnhoefer ..... G06F 3/0443 345/207
2018/0033378 A1* 2/2018 Li ..... G09G 3/34
2019/0180695 A1* 6/2019 Ha ..... G09G 3/3266
2019/0244572 A1* 8/2019 Le ..... G09G 3/36

* cited by examiner

*Primary Examiner* — Ryan A Lubit
(74) *Attorney, Agent, or Firm* — FisherBroyles, LLP

(57) ABSTRACT

The disclosed computer-implemented method may include determining a frame rate for a current frame, where the frame rate dictates the amount of time the current frame is to be presented on a display. The display may be a backlight that is powered for a specified amount of time as part of a duty cycle. The method may further include calculating a backlight duty cycle time for the current frame. The backlight duty cycle time may include a minimum amount of powered time plus an additional amount of powered time that is dependent on the frame rate for the current frame. The method may further generate a drive signal for the display using the calculated backlight duty cycle time and driving the display using the generated drive signal. Various other methods, systems, and computer-readable media are also disclosed.

20 Claims, 10 Drawing Sheets

Lookup Table 500

| Display Refresh Rate | 60HZ | 72HZ | 80HZ | 90HZ |
|---|---|---|---|---|
| Computation | $t_{min}+t_1+t_2+t_3+t_4$ | $t_{min}+t_1+t_2+t_3$ | $t_{min}+t_1+t_2$ | $t_{min}+t_1$ |
| Result | $t_{min}$+1.67msec | $t_{min}$+1.39msec | $t_{min}$+1.25msec | $t_{min}$+1.11msec |

501 502 503

ADAPTIVE SYNCHRONIZATION

CROSS REFERENCE TO RELATED APPLICATION

This application claims the benefit of U.S. Provisional Application No. 62/860,444, filed Jun. 12, 2019, the disclosure of which is incorporated, in its entirety, by this reference.

BRIEF DESCRIPTION OF THE DRAWINGS

The accompanying drawings illustrate a number of exemplary embodiments and are a part of the specification. Together with the following description, these drawings demonstrate and explain various principles of the present disclosure.

DETAILED DESCRIPTION OF EXEMPLARY EMBODIMENTS

Figure 1:
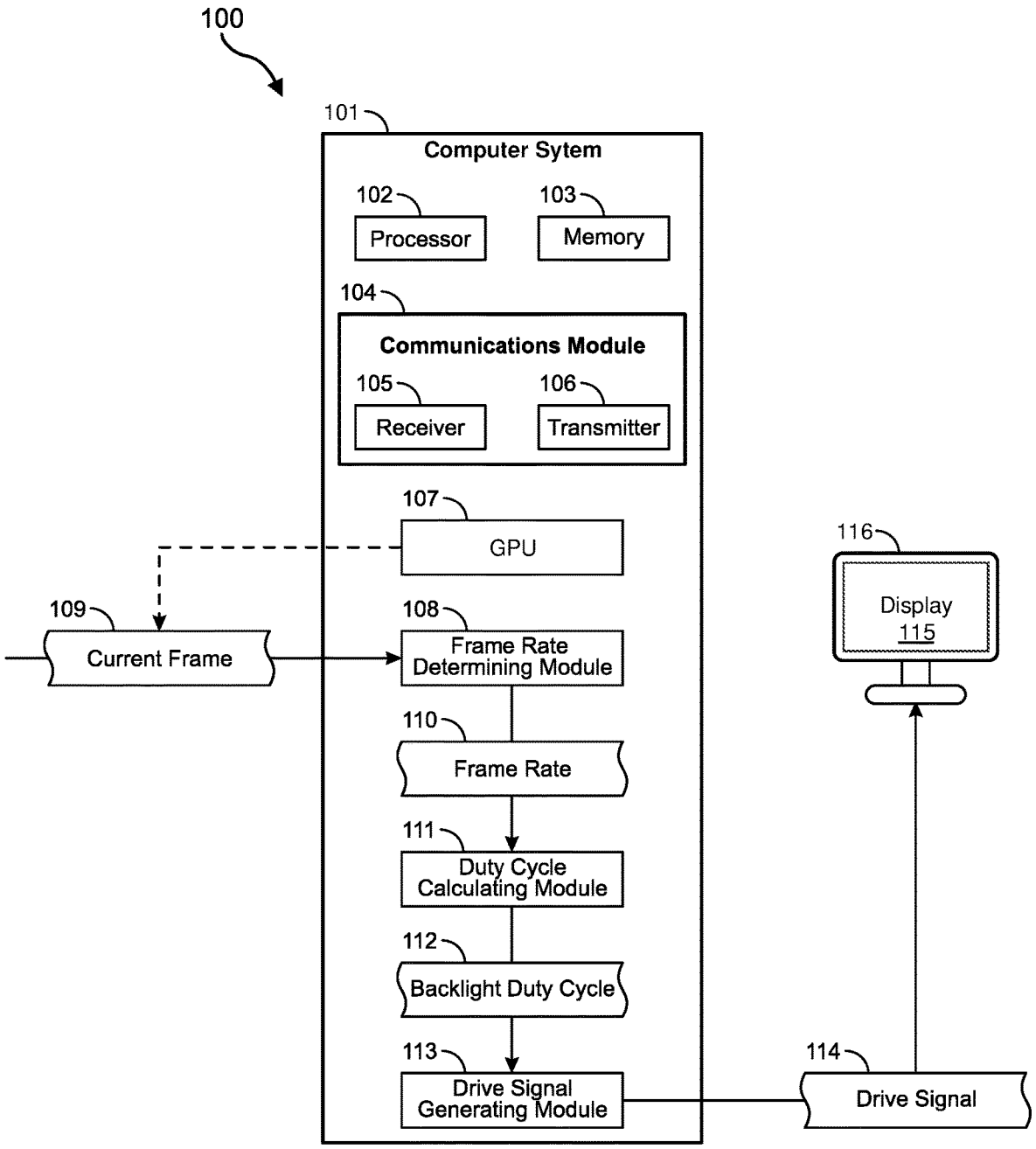
FIG. 1 illustrates a computer architecture in which the embodiments described herein may operate.

The present disclosure is generally directed to methods and systems for adaptively controlling the amount of time a backlight is turned on during the projection of a video frame in an environment where frame rate can vary. Computing system displays, including liquid crystal display (LCD) monitors, light emitting diode (LED) monitors, touch-screens, televisions, virtual or augmented reality displays, or other types of displays typically implement a backlight to provide luminance. In most traditional displays, the backlight is powered on whenever the display is turned on. Each type of display has an associated display refresh rate (e.g., 60 Hz, 90 Hz, 120 Hz, etc.). This display refresh rate indicates the number of times the display device will refresh the screen each second.

Video or other content presented on the display device has its own rate of creation generally referred to as a "frame rate." The graphics processing unit (GPU) of the computer, television, or artificial reality device typically generates the video frames. The GPU takes the underlying video content and creates video frames which are sent to the display device. In some cases, these video frames may be generated at a steady rate (e.g., 30 frames per second (fps)). However, in many cases, such as with video games or even in movies, the frame rate may vary wildly over time, rising to 100+fps, and then dropping a few seconds later to 20 fps. In order to ensure that the display refresh rate of the display device and the output frame rate of the video content are in synch, traditional systems attempt to align the frame rate output by the GPU and the display refresh rate on the monitor. Properly aligning the video frame rate and the display refresh rate may avoid issues such as judder, tearing of the frame displayed on the screen, or other similar issues.

These traditional systems, however, do not attempt to adjust the amount of time the backlight is turned on during the projection of a given frame. In most traditional systems, the backlight is on 100% of the time, providing luminance for the LCD or LED screen. In some embodiments, however, such as with artificial reality systems, it may be desirable to use low-persistence display devices where the backlight is not constantly turned on. In low-persistence displays, the backlight may only be turned on only 10% of the time the video frame is displayed on the screen. If the backlight and the display refresh rate are not in synch, however, the backlight may be powered on too long relative to the refresh rate of the display. In such cases, users may notice changes in brightness as they are viewing the content on the display device. Still further, the amount of time the backlight is powered on (e.g., the "backlight duty cycle") may be varied based on the frame rate of the frames generated by the GPU.

Thus, the embodiments described herein may vary the backlight duty cycle based on the currently-used display refresh rate and/or based on the currently-used video frame rate. As such, at least in some embodiments, when video frame rates vary, the backlight duty cycle may also vary. For example, video frames produced at a higher frame rate (e.g., 90 fps) may have a shorter backlight duty cycle, and video frames produced at a lower frame rate (e.g., 60 fps) may have a longer backlight duty cycle. Similarly, video frames produced at a constant rate but displayed on a higher-refresh-rate display (e.g., 90 Hz) may have a shorter backlight duty cycle, and video frames displayed on a lower-refresh-rate display device (e.g., 60 Hz) may have a longer backlight duty cycle. By adapting the duty cycle of the backlight to the refresh rate of the display device and/or to the frame rate of the video frames created by the GPU, the display device may create a more consistent image with fewer changes in brightness as the frame rate varies during use.

FIG. 1 illustrates a computing environment 100 that includes a computer system 101. The computer system 101 may be substantially any type of computer system including a local computer system or a distributed (e.g., cloud) computer system. The computer system 101 includes at least one processor 102 and at least some system memory 103. The computer system 101 also includes program modules for performing a variety of different functions. The program modules are hardware-based, software-based, or include a combination of hardware and software. Each program module uses computing hardware and/or software to perform specified functions, including those described herein below.

For example, the communications module 104 communicates with other computer systems. The communications module 104 includes wired or wireless communication means that receive and/or transmit data to or from other computer systems. These communication means may include hardware radios including, for example, a hardware-based receiver 105, a hardware-based transmitter 106, or a combined hardware-based transceiver capable of both receiving and transmitting data. The radios may be WIFI radios, cellular radios, Bluetooth radios, global positioning system (GPS) radios, or other types of radios. The communications module 104 interacts with databases, mobile computing devices (such as mobile phones or tablets), embedded or other types of computing systems.

The computer system 101 also includes a graphics processing unit (GPU) 107. The GPU 107 may be any type of GPU including a dedicated chipset, a combined CPU/GPU chipset, a discrete hardware unit, or other type of graphics processing unit. The GPU may include multiple processors, multiple cores, dedicated memory, high-capacity bridges, and other associated hardware. In some cases, the GPU 107 may include a plurality of GPUs acting together to generate a video frame 109 or series of frames. The video frames may correspond to video content including movies, television shows, web videos, etc., video game content, streaming content, still images, or any other content presentable on a display (e.g., 115). The GPU thus generates multiple sequential frames for viewing on the display.

Each frame 109 may be generated at a specific frame rate. The frame rate determining module 108 of computer system 101 may determine the frame rate for each current frame as it is generated by the GPU 107. The determined frame rate 110 may then be passed to the duty cycle calculating module 111 of computer system 101. The duty cycle calculating module 111 may be configured to calculate a backlight duty cycle 112 for the backlight 116 of display 115. As noted above, for low-persistence displays such as those used in conjunction with virtual or augmented reality devices, the display's backlight 116 is typically only powered for a percentage of the total time the frame is displayed.

Thus, in the embodiments described herein, if the frame rate for current frame 109 is relatively high (meaning that the frame will be shown for a shorter amount of time on the display 115), then the duty cycle calculating module 111 may calculate a backlight duty cycle that is relatively shorter in length. Conversely, if the frame rate for the current frame 109 is relatively low (meaning that the frame will be shown for a longer amount of time on the display 115), then the duty cycle calculating module 111 may calculate a power duty cycle that is relatively longer in length. As such, the amount of time the backlight 116 is powered on may be dependent on the frame rate 110 which, at least in some cases, may vary a great deal over time. By calculating the backlight duty cycle in conjunction with the frame rate for each frame (or for a subset of the generated frames), the backlight may have a more consistent feel across multiple hundreds, thousands, or millions of frames. The consistent feel may lead to a more immersive artificial reality experience that is more lifelike and is minimally distracting.

As will be explained in greater detail below, embodiments of the present disclosure may adaptively control the amount of time a backlight is turned on during the projection of a frame in an environment where frame rate can vary. Features from any of the embodiments described herein may be used in combination with one another in accordance with the general principles described herein. These and other embodiments, features, and advantages will be more fully understood upon reading the following detailed description in conjunction with the accompanying drawings and claims, including method 200 of FIG. 2.

Figure 2:
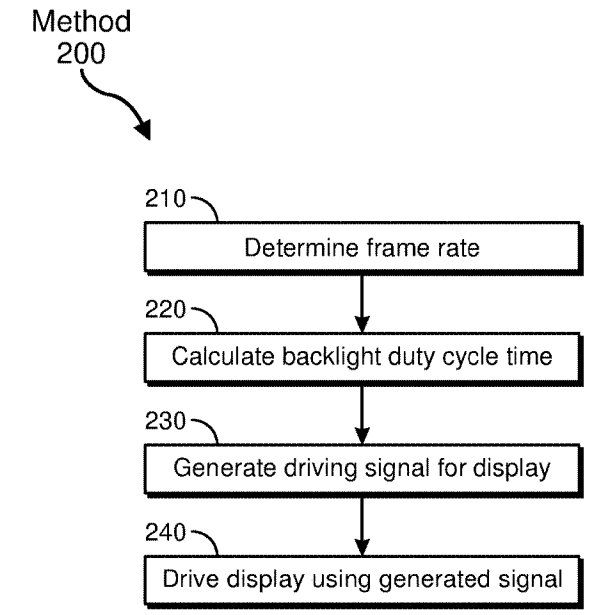
FIG. 2 is a flow diagram of an exemplary method for adaptively synchronizing a backlight duty cycle with a video's frame rate.

FIG. 2 is a flow diagram of an exemplary computer-implemented method 200 for adaptively controlling a backlight duty cycle. The steps shown in FIG. 2 may be performed by any suitable computer-executable code and/or computing system, including the system illustrated in FIG. 1. In one example, each of the steps shown in FIG. 2 may represent an algorithm whose structure includes and/or is represented by multiple sub-steps, examples of which will be provided in greater detail below.

As illustrated in FIG. 2, at step 210 one or more of the systems described herein may determine a frame rate for a current frame. For example, the frame rate determining module 108 of FIG. 1 may determine the frame rate 110 for current frame 109. The frame rate 110 may dictate the amount of time the current frame is to be presented on a display (e.g., display 115). The display may include a backlight 116 that is powered for a specified amount of time as part of a duty cycle. The backlight provides light to an LCD display or to an LED display or other type of display. The backlight may be a cold cathode fluorescent (CCFL) backlight, an LED backlight, or any other type of backlight. In low-persistence displays, the backlight may only be illuminated or powered for a small percentage of the time that the current frame 109 is presented on the display 115. The powering of the display's backlight 116 may be controlled by a duty cycle 112.

At step 220 of FIG. 2, the duty cycle calculating module may calculate a backlight duty cycle time for the current frame 109. The backlight duty cycle time 112 may include a specified minimum amount of powered time plus an additional amount of powered time that is dependent on the frame rate for the current frame. In contrast to traditional systems that power the backlight 100% of the time, or that power the backlight at a fixed percentage of the time, the embodiments described herein may vary the amount of time the backlight 116 is powered on according to the frame rate 110 of the current frame 109. Thus, during periods where the GPU 107 is generating video frames at a high rate, the backlight duty cycle 112 may be shorter to more closely align with the shorter display times of the video frames. Conversely, during periods where the GPU 107 is generating video frames at a low rate (e.g., during a highly active part of a video game), the backlight duty cycle 112 may be longer to align with the longer display times of the video frames.

In at least some embodiments, the refresh rate of the display 115 may be fixed. Thus, for instance, the display refresh rate may be 60 Hz, 120 Hz, 240 Hz, or some other refresh rate. This refresh rate may not change, despite any changes in frame rate 110. Thus, if the backlight duty cycle 112 were calculated simply using the refresh rate of the display, the backlight duty cycle would not vary unless the refresh rate of the display was changed. Of course, the refresh rate of the display device 115 may be changed in some cases, but such changes are typically rare. Changes to the frame rate of the video frames 109 generated by the GPU 107, however, are (at least in some embodiments) substantially constant, changing with each frame. Accordingly, changes to the backlight duty cycle 112 based on video frame rate changes are focused on more heavily in the description herein. Although, it should be noted that the backlight duty cycle 112 may be changed for different display refresh rates in addition to any changes made to the backlight duty cycle in response to changes in video frame rate.

At step 230 of FIG. 2, the drive signal generating module 113 of FIG. 1 may generate a drive signal 114 for the display 115 using the calculated backlight duty cycle time 112 and, at step 240, may drive the display 115 using the generated drive signal 114. Accordingly, the backlight 116 of the display 115 may be powered for the calculated backlight duty cycle time 112 during presentation of the current frame 109 on the display 115. The generated drive signal 114 may be used to drive a single display (e.g., 115) or may be used to drive a plurality of displays. For instance, if a user is implementing three (or more) monitors to provide a more immersive field of view, the same drive signal 114 may be provided to all three monitors to control each of their backlight duty cycles simultaneously.

Figure 3:
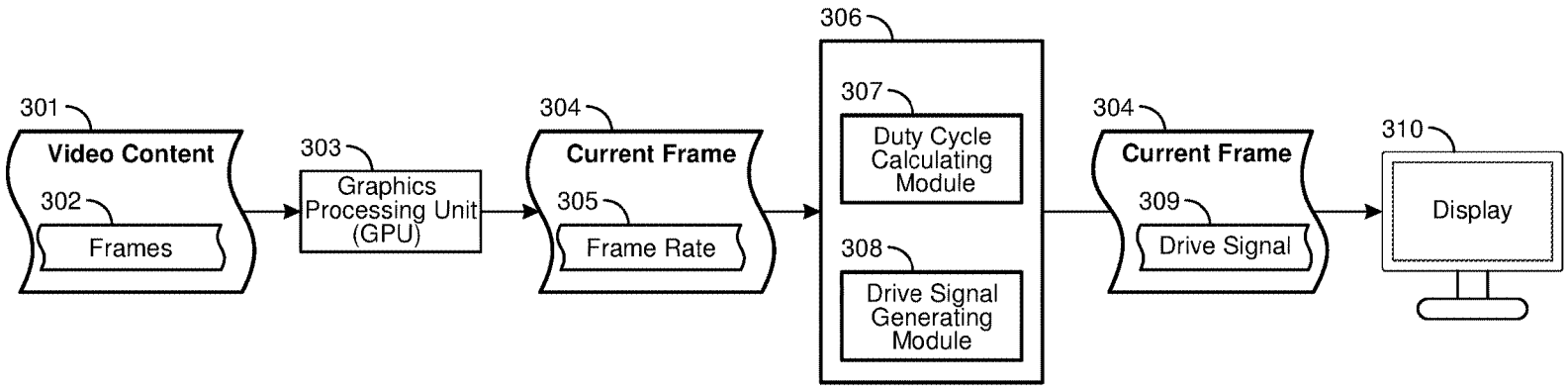
FIG. 3 illustrates an embodiment in which a backlight duty cycle is synchronized with a videos' frame rate.

FIG. 3 illustrates an embodiment where a current video frame (e.g., 109 of FIG. 1) may be part of media content that has multiple video frames. For example, video content 301 may include large numbers of video frames 302. In the case of movies or television shows, the video content 301 may include tens or hundreds of thousands of video frames 302. In the case of video games (e.g., virtual reality or augmented reality video games), the video content 301 may be ongoing until the user is finished playing the game and may thus include millions of video frames over time. Regardless of which type of video content 301 is to be displayed on a display (e.g., 310), the video content is provided to a GPU 303 which assembles the video content into frames that are presentable on the display 310. The current frame 304 may be a single frame in a series of frames generated by the GPU. Each frame may be generated at a specific rate and may be displayed on the display 310 at that frame rate 305.

In some embodiments, as shown in FIG. 3, the duty cycle calculating module 307 and the drive signal generating module 308 may be part of the same chipset 306. The duty cycle calculating module 307 and the drive signal generating module 308 may be encoded in hardware such as an application specific integrated circuit (ASIC) or field-programmable gate array (FPGA). Once the duty cycle calculating module 307 has calculated a backlight duty cycle for the current frame 304 and after the drive signal generating module 308 has generated a drive signal 309, the current frame and drive signal may be sent together to the display 310 so that the current frame 304 is displayed on the display 310 and the backlight is powered according to the calculated backlight duty cycle. In this manner, each frame 304 that is generated by the GPU may have its own backlight duty cycle time. Stated another way, the backlight duty cycle time may be calculated dynamically for, and may be unique to, each frame 304 generated by the GPU 303. Then, even if the frame rate changes during a portion of video content 301, the dynamic calculation may change for the different frame rate and may calculate a backlight duty cycle that corresponds to the frame rate for that frame. This dynamically-calculated backlight duty cycle time may provide a display that is smooth and flicker-free, even with a continually-changing frame rate.

Figure 4:
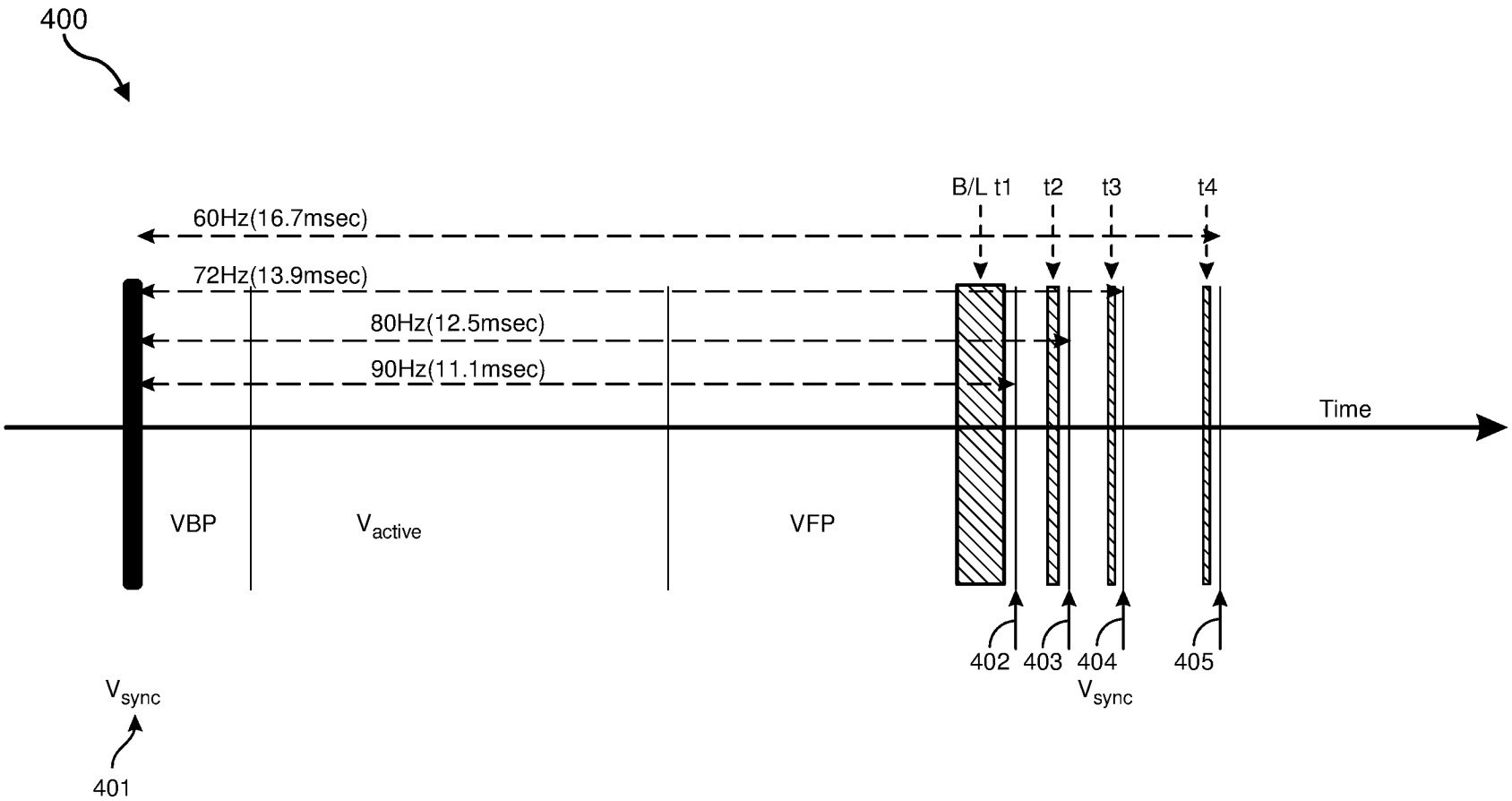
FIG. 4 illustrates an embodiment in which backlight timing is adjusted based on video frame rate.

FIG. 4 illustrates a chart 400 that shows a timeframe between vertical synchs on a display. As noted above, displays are refreshed a certain number of times each second (e.g., 60 Hz, 90 Hz, 120 Hz, etc.). At each refresh of the display, a vertical synch may occur where the previous frame is no longer displayed and the new frame is about to be displayed. The chart indicates that a 60 Hz refresh lasts 16.7 msec and, as a relatively slow refresh rate, extends from Vsynch 401 to Vsynch 405. The 72 Hz refresh lasts 13.9 msec and extends from Vsynch 401 to Vsynch 404, 80 Hz refresh lasts 12.5 msec and extends from Vsynch 401 to Vsynch 403, and 90 Hz refresh lasts 11.1 msec and goes from Vsynch 401 to Vsynch 402.

The amount of time the backlight is powered may be indicated by the hashed columns t1-t4. At least in some embodiments, the backlight (e.g., 116 of FIG. 3) may be powered during time t1 for 90 Hz refresh-rate displays. This may be a minimum amount of time for the backlight to be powered on. For the 80 Hz refresh-rate display, the backlight may be powered for the time t1 plus an additional amount of time indicated by t2. The backlight may be powered for times t1+t2+t3 for the 72 Hz refresh-rate display, and times t1+t2+t3+t4 for the 60 Hz refresh-rate display. These backlight duty cycle times may be pre-calculated and may be stored in a lookup table (e.g., lookup table 500 of FIG. 5). By pre-calculating the backlight duty cycle times for different display refresh rates, some of the calculations performed by the duty cycle calculating module 111 may be reduced. Indeed, if the backlight duty cycle time is already known and calculated for different display device refresh rates, the calculations for varying the backlight duty cycle time based on generated video frame rates may be simplified.

Figures 5, 6:
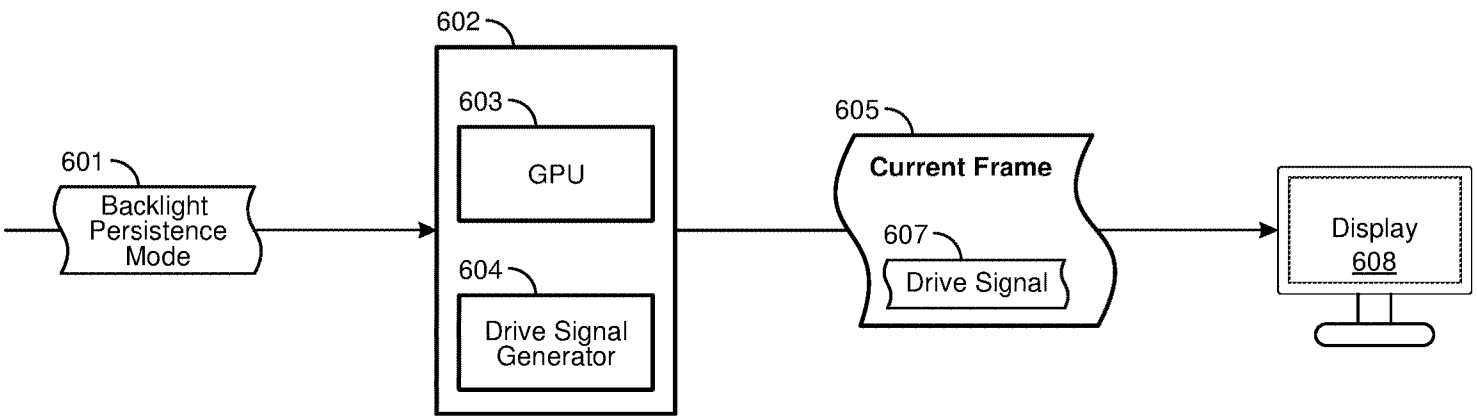
FIG. 5 illustrates an embodiment of a lookup table implemented to identify a backlight duty cycle time.
FIG. 6 illustrates an embodiment in which a backlight duty cycle is altered based on the backlight persistence mode.

FIG. 5 illustrates a lookup table 500 that lists, at least in one embodiment, how pre-calculated backlight duty cycle times are computed. For example, at a display refresh rate (501) of 60 Hz, the amount of time the backlight is powered on may be tmin+t1+t2+t3+t4. Other computations 502 are also shown for other display refresh rates including 72 Hz, 80 Hz, and 90 Hz. In some embodiments, these amounts (shown in results 503) may be added to the calculated backlight duty cycle 112 of FIG. 1. For instance, as noted above, once the display's refresh rate is set, it is typically not changed. However, the frame rate of the generated video frames may change continually. Thus, in some cases, the backlight duty cycle times 503 may be added to or subtracted from the backlight duty cycle times calculated based on determined frame rate 110.

Accordingly, if the duty cycle calculating module 111 of computer system 101 calculated a backlight duty cycle time 112 for a specific frame 109 at a specified frame rate 110, that frame-rate specific duty cycle computation may be used in conjunction with the pre-calculated duty cycle times at 503 in the lookup table 500. In this manner, the frame-rate-specific backlight duty cycle time may be combined with the pre-calculated refresh-rate-specific backlight duty cycle to result in a backlight duty cycle time that is specific to that frame 109 and is specific to the refresh rate of the display 115. Because the backlight duty cycle time is calculated with deference to both the display's refresh rate and the frame rate of the video frame, (i.e., they are each in synch), the backlight will not be powered on in between vertical synchs. If the backlight were powered on between vertical synchs, users may notice and become distracted. Instead, the backlight and the vertical synchs remain in synch and the backlight is powered according to the frame rate and display refresh rate. The amount of time the backlight is powered on may thus be proportionate to the total time the current frame is displayed while still varying with each frame.

In some embodiments, the duty cycle calculating module 111 of FIG. 1 may consult the lookup table 500 for each current frame (e.g., 109) to determine the appropriate backlight duty cycle time 112 for that frame. By having at least a portion of the backlight duty cycle time 112 pre-calculated, the overall amount of time used to calculate the backlight duty cycle time 112 may be reduced. This reduction in computational time may result in fewer CPU, memory, and other computing resources being used. In cases where the computer system 101 is a mobile device, this reduction in computing resources may result in longer battery life and more resources available for other tasks.

In some cases, the lookup table may also include pre-calculated backlight duty cycle times based on video frame rate. For instance, a lookup table may show, for a 60 Hz refresh rate display, a calculation of backlight duty cycle times for video frame rates of 1 fps to 100 fps. Another lookup table may include a calculation of backlight duty cycle times for video frame rates of 1 fps to 100 fps for a 72 Hz refresh rate. Another lookup table may include such for 80 Hz refresh rate displays, or 90 Hz refresh rate displays, or 120 Hz refresh rate displays. Thus, in such cases, if a video frame has a frame rate of 71 fps and is to be displayed on a display that refreshes at 120 Hz, the duty cycle calculating module 111 may consult the lookup table for a 120 Hz refresh rate, find the pre-calculated backlight duty cycle time for 71 fps, and use that value to create the drive signal. Once the duty cycle calculating module 111 has calculated the backlight duty cycle time 112 for that frame (e.g., 109), the drive signal generating module 113 may generate the drive signal 114 that drives the display 115 according to the duty cycle time generated based on the pre-calculated values. It will be recognized here that the numbers mentioned in regard to these lookup tables were chosen arbitrarily, and that substantially any number of lookup tables may be used with substantially any number of pre-calculated backlight duty cycle times.

FIG. 6 illustrates an embodiment in which a backlight persistence mode 601 is used as a factor when calculating a backlight duty cycle time (e.g., 112 of FIG. 1). For instance, the display 608 may be a low-persistence display. The low-persistence display may be part of an artificial reality device such as a virtual reality device or an augmented reality device. The low-persistence display 608 may be operated according to a persistence mode that reduces the amount of time the display's backlight is powered on. High-persistence modes, on the other hand, may increase the amount of time the display's backlight is powered. The backlight persistence mode 601 may be provided as an input to a chipset 602 that includes a GPU 603 and/or a drive signal generator 604, along with potentially other components such as a duty cycle calculator. The GPU may generate frames as described in reference to GPU 107 of FIG. 1 and a duty cycle calculating module may calculate a duty cycle that is commensurate with the backlight persistence mode 601. The drive signal generator 604 may then generate a drive signal 607 and send the drive signal, along with the generated frame 605, to the display 608. In such embodiments, the backlight persistence mode 601 may be configurable by a viewer of the display to have more or less persistence.

In some cases, the refresh rate of the display may be synchronized according to the backlight persistence mode. For instance, in cases where the refresh rate of the display 608 is 90 Hz, the backlight persistence mode 601 may indicate that the backlight is only to be powered on 10% of the time each frame is displayed. In cases where the frame rate for each frame varies, the 10% backlight powered time may be different for each frame as 10% of different values results in different outcomes. Thus, the backlight persistence mode 601 may indicate a certain level of overall persistence that is to be achieved in the display 608, and the drive signal generator 604 that drives the display 608 may generate the drive signal 607 according to the specified backlight persistence mode. In some embodiments, the display refresh rate may be synchronized with the backlight persistence mode as in the example above, and may be further synchronized with a graphics processing unit (GPU) frame rate associated with a GPU that generates the current frame.

Thus, in cases where the GPU 603 is producing video frames 605 at a very high rate, and in cases where the backlight persistence mode is set to "Low," the drive signal generator 604 may generate a drive signal 607 that drives the display's backlight for a shorter amount of time, as each of the frames is shown on the display for a relatively shorter amount of time. Conversely, in cases where the backlight persistence mode is set to "High," the drive signal generator 604 may generate a drive signal 607 that drives the display's backlight for a longer amount of time, as each of the frames is shown on the display 608 for a relatively longer amount of time. In some cases, the user may be able to change the backlight persistence mode if the user wants more or less backlight.

Alternatively, the backlight persistence mode may be set to change automatically. For example, in cases where the display 608 is a virtual reality display (e.g., 902 of FIG. 9 below), the virtual reality display may include one or more internal or external sensors. Those sensors may identify characteristics of the user's surroundings. Other data, including simultaneous localization and mapping (SLAM) data may also be received by or generated at the virtual reality device. The virtual reality device may use this data to determine when a higher or lower backlight persistence mode is to be used. Upon determining that the user's environment is dark, for example, the backlight persistence mode 601 may automatically change to a lower persistence mode. Upon determining that the user's environment is light (e.g., the virtual reality device is being used outdoors in a user's backyard), on the other hand, the backlight persistence mode 601 may automatically change to a higher persistence mode to better align with the user's current surroundings. Then, if a user is in an especially dark or light setting, the user's eyes will not need as long to adjust to the virtual reality display. The backlight persistence mode 601 may thus be selected automatically and may also adjust automatically according to sensor data or according to other factors in the user's environment.

A corresponding system may include at least one physical processor, and physical memory comprising computer-executable instructions that, when executed by the physical processor, cause the physical processor to: determine a frame rate for a current frame, where the frame rate dictates the amount of time the current frame is to be presented on a display, and where the display includes a backlight that is powered for a specified amount of time as part of a duty cycle, calculate a backlight duty cycle time for the current frame, where the backlight duty cycle time includes a specified minimum amount of powered time plus an additional amount of powered time that is dependent on the frame rate for the current frame, generate a drive signal for the display using the calculated backlight duty cycle time, and drive the display using the generated drive signal, such that the backlight of the display is powered for the calculated backlight duty cycle time during the current frame.

A corresponding non-transitory computer-readable medium may include one or more computer-executable instructions that, when executed by at least one processor of a computing device, cause the computing device to: determine a frame rate for a current frame, where the frame rate dictates the amount of time the current frame is to be presented on a display, and where the display includes a backlight that is powered for a specified amount of time as part of a duty cycle, calculate a backlight duty cycle time for the current frame, where the backlight duty cycle time includes a specified minimum amount of powered time plus an additional amount of powered time that is dependent on the frame rate for the current frame, generate a drive signal for the display using the calculated backlight duty cycle time, and drive the display using the generated drive signal, such that the backlight of the display is powered for the calculated backlight duty cycle time during the current frame.

In this manner, methods and systems are provided that adjust a duty cycle of a display's backlight according to the frame rate of the video frames generated by the graphics processing unit. Adjusting the display's backlight in this manner may reduce noticeable backlight flickering in cases where the frame rate varies between frames. Moreover, adjusting the backlight to run in a low-persistence mode may reduce fatigue on the user's eyes and may provide for a more immersive artificial reality experience. Still further, the methods and systems herein may allow a user to change the persistence mode of the display and may also allow the persistence mode to be changed automatically based on various factors in the user's current environment.

EXAMPLE EMBODIMENTS

Example 1

A computer-implemented method may include determining a frame rate for a current frame, the frame rate dictating the amount of time the current frame is to be presented on a display, the display including a backlight that is powered for a specified amount of time as part of a duty cycle, calculating a backlight duty cycle time for the current frame, the backlight duty cycle time comprising a specified minimum amount of powered time plus an additional amount of powered time that is dependent on the frame rate for the current frame, generating a drive signal for the display using the calculated backlight duty cycle time, and driving the display using the generated drive signal, such that the backlight of the display is powered for the calculated backlight duty cycle time during the current frame.

Example 2

The computer-implemented method of Example 1, wherein the current frame is part of a portion of media content having a plurality of video frames.

Example 3

The computer-implemented method of any of Examples 1 and 2, wherein the backlight duty cycle times are calculated dynamically for each frame.

Example 4

The computer-implemented method of any of Examples 1-3, wherein the frame rate changes during a portion of media content, and wherein the dynamic calculation changes for the different frame rate.

Example 5

The computer-implemented method of any of Examples 1-4, wherein the backlight duty cycle times are pre-calculated for a plurality of different frame rates.

Example 6

The computer-implemented method of any of Examples 1-5, wherein the amount of time the backlight is powered on is proportionate to a total time the current frame is displayed.

Example 7

The computer-implemented method of any of Examples 1-6, wherein the amount of time the backlight is powered on is longer for lower frame rates and is shorter for higher frame rates.

Example 8

The computer-implemented method of any of Examples 1-7, wherein the display comprises a liquid crystal display (LCD) and wherein the backlight comprises a cold cathode fluorescent (CCFL) backlight.

Example 9

The computer-implemented method of any of Examples 1-8, wherein the display comprises an LCD and wherein the backlight comprises a light emitting diode (LED) backlight.

Example 10

The computer-implemented method of any of Examples 1-9, wherein the display comprises a low-persistence display.

Example 11

The computer-implemented method of any of Examples 1-10, wherein the low-persistence display is part of an artificial reality device.

Example 12

A system comprising: at least one physical processor, and physical memory comprising computer-executable instructions that, when executed by the physical processor, cause the physical processor to: determine a frame rate for a current frame, the frame rate dictating the amount of time the current frame is to be presented on a display, the display including a backlight that is powered for a specified amount of time as part of a duty cycle, calculate a backlight duty cycle time for the current frame, the backlight duty cycle time comprising a specified minimum amount of powered time plus an additional amount of powered time that is dependent on the frame rate for the current frame, generate a drive signal for the display using the calculated backlight duty cycle time, and drive the display using the generated drive signal, such that the backlight of the display is powered for the calculated backlight duty cycle time during the current frame.

Example 13

The system of Example 12, wherein the backlight is operated according to a specified persistence mode.

Example 14

The system of any of Examples 12-13, wherein the display refresh rate is synchronized according to the backlight persistence mode.

Example 15

The system of any of Examples 12-14, wherein the display refresh rate is synchronized according to the backlight persistence mode and is further synchronized with a graphics processing unit (GPU) frame rate associated with a GPU that generates the current frame.

Example 16

The system of any of Examples 12-15, wherein the backlight duty cycle times are pre-calculated for a plurality of different display refresh rates.

Example 17

The system of any of Examples 12-16, wherein the pre-calculated backlight duty cycle times are stored in a lookup table.

Example 18

The system of any of Examples 12-17, wherein the lookup table is consulted for each current frame to determine the appropriate backlight duty cycle time for that frame.

Example 19

The system of any of Examples 12-18, wherein the drive signal for the display is generated based on the pre-calculated backlight duty cycle times.

Example 20

A non-transitory computer-readable medium comprising one or more computer-executable instructions that, when executed by at least one processor of a computing device, cause the computing device to: determine a frame rate for a current frame, the frame rate dictating the amount of time the current frame is to be presented on a display, the display including a backlight that is powered for a specified amount of time as part of a duty cycle, calculate a backlight duty cycle time for the current frame, the backlight duty cycle time comprising a specified minimum amount of powered time plus an additional amount of powered time that is dependent on the frame rate for the current frame, generate a drive signal for the display using the calculated backlight duty cycle time, and drive the display using the generated drive signal, such that the backlight of the display is powered for the calculated backlight duty cycle time during the current frame.

Embodiments of the present disclosure may include or be implemented in conjunction with various types of artificial reality systems. Artificial reality is a form of reality that has been adjusted in some manner before presentation to a user, which may include, e.g., a virtual reality, an augmented reality, a mixed reality, a hybrid reality, or some combination and/or derivative thereof. Artificial-reality content may include completely generated content or generated content combined with captured (e.g., real-world) content. The artificial-reality content may include video, audio, haptic feedback, or some combination thereof, any of which may be presented in a single channel or in multiple channels (such as stereo video that produces a three-dimensional effect to the viewer). Additionally, in some embodiments, artificial reality may also be associated with applications, products, accessories, services, or some combination thereof, that are used to, e.g., create content in an artificial reality and/or are otherwise used in (e.g., to perform activities in) an artificial reality.

Artificial-reality systems may be implemented in a variety of different form factors and configurations. Some artificial reality systems may be designed to work without near-eye displays (NEDs), an example of which is augmented-reality system 700 in FIG. 7. Other artificial reality systems may include a NED that also provides visibility into the real world (e.g., augmented-reality system 800 in FIG. 8) or that visually immerses a user in an artificial reality (e.g., virtual-reality system 900 in FIG. 9). While some artificial-reality devices may be self-contained systems, other artificial-reality devices may communicate and/or coordinate with external devices to provide an artificial-reality experience to a user. Examples of such external devices include handheld controllers, mobile devices, desktop computers, devices worn by a user, devices worn by one or more other users, and/or any other suitable external system.

Figure 7:
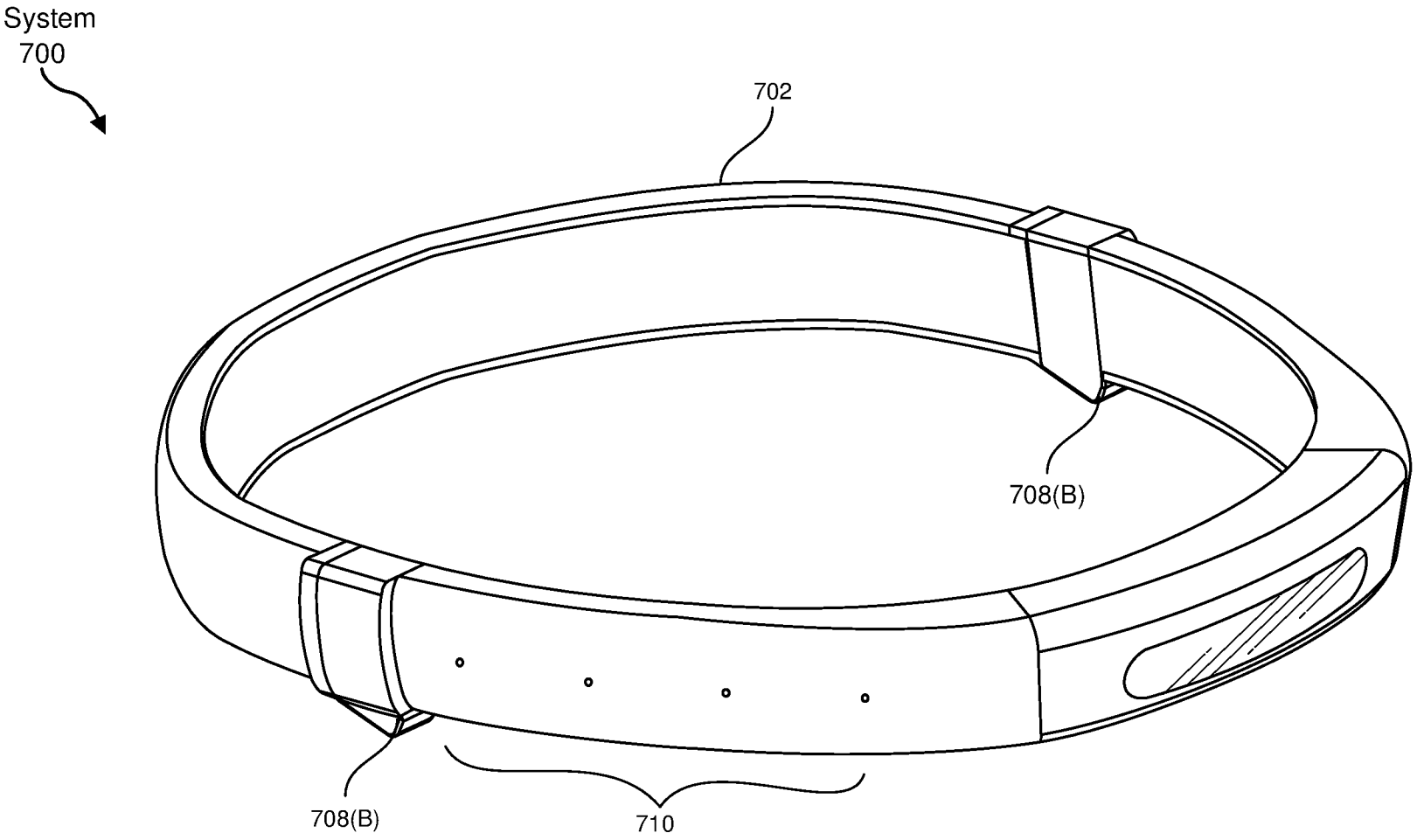
FIG. 7 is an illustration of an exemplary artificial-reality headband that may be used in connection with embodiments of this disclosure.

Turning to FIG. 7, augmented-reality system 700 generally represents a wearable device dimensioned to fit about a body part (e.g., a head) of a user. As shown in FIG. 7, system 700 may include a frame 702 and a camera assembly 704 that is coupled to frame 702 and configured to gather information about a local environment by observing the local environment. Augmented-reality system 700 may also include one or more audio devices, such as output audio transducers 708(A) and 708(B) and input audio transducers 710. Output audio transducers 708(A) and 708(B) may provide audio feedback and/or content to a user, and input audio transducers 710 may capture audio in a user's environment.

As shown, augmented-reality system 700 may not necessarily include a NED positioned in front of a user's eyes. Augmented-reality systems without NEDs may take a variety of forms, such as head bands, hats, hair bands, belts, watches, wrist bands, ankle bands, rings, neckbands, necklaces, chest bands, eyewear frames, and/or any other suitable type or form of apparatus. While augmented-reality system 700 may not include a NED, augmented-reality system 700 may include other types of screens or visual feedback devices (e.g., a display screen integrated into a side of frame 702).

Figure 8:
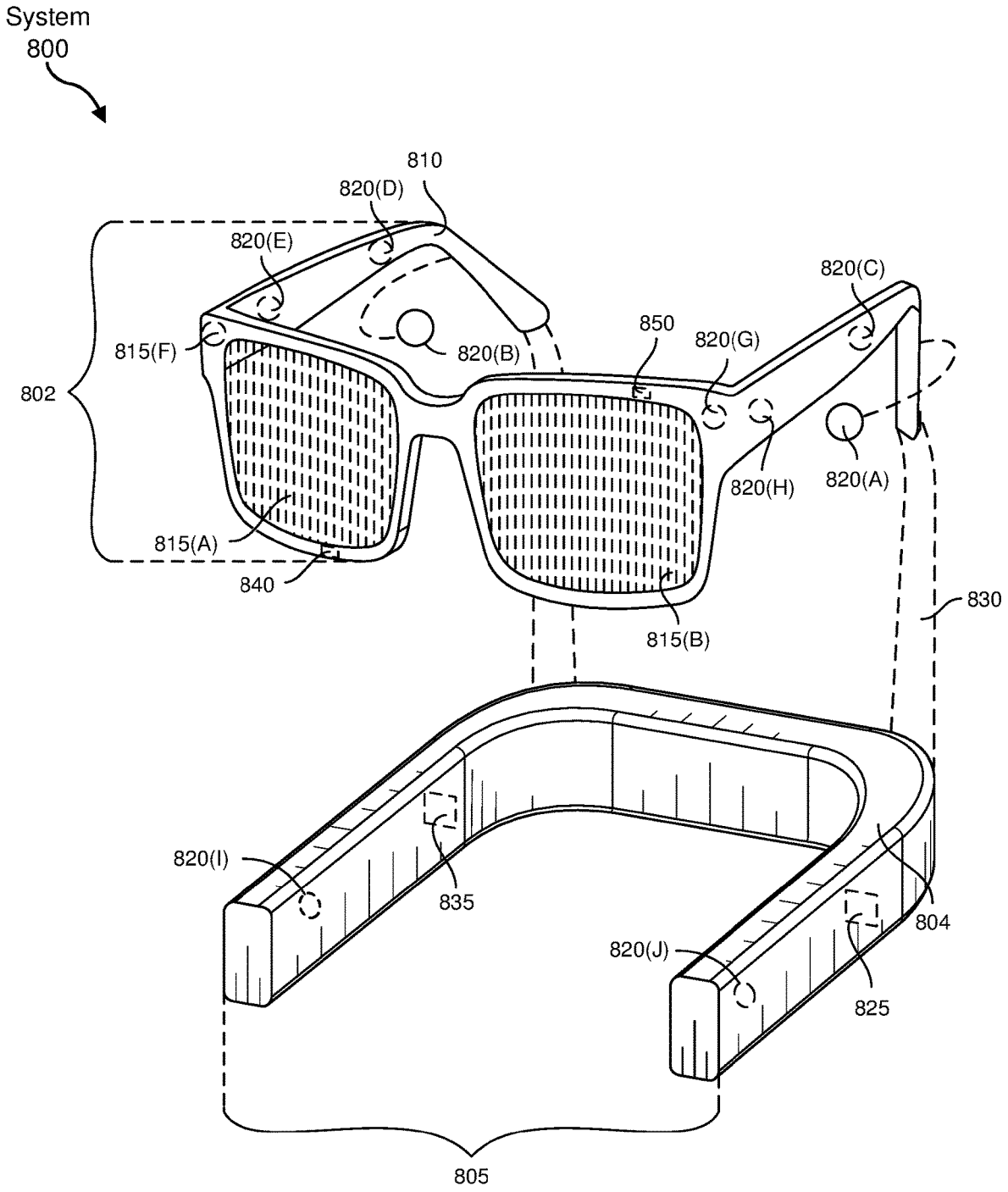
FIG. 8 is an illustration of exemplary augmented-reality glasses that may be used in connection with embodiments of this disclosure.

The embodiments discussed in this disclosure may also be implemented in augmented-reality systems that include one or more NEDs. For example, as shown in FIG. 8, augmented-reality system 800 may include an eyewear device 802 with a frame 810 configured to hold a left display device 815(A) and a right display device 815(B) in front of a user's eyes. Display devices 815(A) and 815(B) may act together or independently to present an image or series of images to a user. While augmented-reality system 800 includes two displays, embodiments of this disclosure may be implemented in augmented-reality systems with a single NED or more than two NEDs.

In some embodiments, augmented-reality system 800 may include one or more sensors, such as sensor 840. Sensor 840 may generate measurement signals in response to motion of augmented-reality system 800 and may be located on substantially any portion of frame 810. Sensor 840 may represent a position sensor, an inertial measurement unit (IMU), a depth camera assembly, or any combination thereof. In some embodiments, augmented-reality system 800 may or may not include sensor 840 or may include more than one sensor. In embodiments in which sensor 840 includes an IMU, the IMU may generate calibration data based on measurement signals from sensor 840. Examples of sensor 840 may include, without limitation, accelerometers, gyroscopes, magnetometers, other suitable types of sensors that detect motion, sensors used for error correction of the IMU, or some combination thereof.

Augmented-reality system 800 may also include a microphone array with a plurality of acoustic transducers 820(A)-820(J), referred to collectively as acoustic transducers 820. Acoustic transducers 820 may be transducers that detect air pressure variations induced by sound waves. Each acoustic transducer 820 may be configured to detect sound and convert the detected sound into an electronic format (e.g., an analog or digital format). The microphone array in FIG. 2 may include, for example, ten acoustic transducers: 820(A) and 820(B), which may be designed to be placed inside a corresponding ear of the user, acoustic transducers 820(C), 820(D), 820(E), 820(F), 820(G), and 820(H), which may be positioned at various locations on frame 810, and/or acoustic transducers 820(I) and 820(J), which may be positioned on a corresponding neckband 805.

In some embodiments, one or more of acoustic transducers 820(A)-(F) may be used as output transducers (e.g., speakers). For example, acoustic transducers 820(A) and/or 820(B) may be earbuds or any other suitable type of headphone or speaker.

The configuration of acoustic transducers 820 of the microphone array may vary. While augmented-reality system 800 is shown in FIG. 8 as having ten acoustic transducers 820, the number of acoustic transducers 820 may be greater or less than ten. In some embodiments, using higher numbers of acoustic transducers 820 may increase the amount of audio information collected and/or the sensitivity and accuracy of the audio information. In contrast, using a lower number of acoustic transducers 820 may decrease the computing power required by the controller 850 to process the collected audio information. In addition, the position of each acoustic transducer 820 of the microphone array may vary. For example, the position of an acoustic transducer 820 may include a defined position on the user, a defined coordinate on frame 810, an orientation associated with each acoustic transducer, or some combination thereof.

Acoustic transducers 820(A) and 820(B) may be positioned on different parts of the user's ear, such as behind the pinna or within the auricle or fossa. Or, there may be additional acoustic transducers on or surrounding the ear in addition to acoustic transducers 820 inside the ear canal. Having an acoustic transducer positioned next to an ear canal of a user may enable the microphone array to collect information on how sounds arrive at the ear canal. By positioning at least two of acoustic transducers 820 on either side of a user's head (e.g., as binaural microphones), augmented-reality device 800 may simulate binaural hearing and capture a 3D stereo sound field around about a user's head. In some embodiments, acoustic transducers 820(A) and 820(B) may be connected to augmented-reality system 800 via a wired connection 830, and in other embodiments, acoustic transducers 820(A) and 820(B) may be connected to augmented-reality system 800 via a wireless connection (e.g., a Bluetooth connection). In still other embodiments, acoustic transducers 820(A) and 820(B) may not be used at all in conjunction with augmented-reality system 800.

Acoustic transducers 820 on frame 810 may be positioned along the length of the temples, across the bridge, above or below display devices 815(A) and 815(B), or some combination thereof. Acoustic transducers 820 may be oriented such that the microphone array is able to detect sounds in a wide range of directions surrounding the user wearing the augmented-reality system 800. In some embodiments, an optimization process may be performed during manufacturing of augmented-reality system 800 to determine relative positioning of each acoustic transducer 820 in the microphone array.

In some examples, augmented-reality system 800 may include or be connected to an external device (e.g., a paired device), such as neckband 805. Neckband 805 generally represents any type or form of paired device. Thus, the following discussion of neckband 805 may also apply to various other paired devices, such as charging cases, smart watches, smart phones, wrist bands, other wearable devices, hand-held controllers, tablet computers, laptop computers and other external compute devices, etc.

As shown, neckband 805 may be coupled to eyewear device 802 via one or more connectors. The connectors may be wired or wireless and may include electrical and/or non-electrical (e.g., structural) components. In some cases, eyewear device 802 and neckband 805 may operate independently without any wired or wireless connection between them. While FIG. 8 illustrates the components of eyewear device 802 and neckband 805 in example locations on eyewear device 802 and neckband 805, the components may be located elsewhere and/or distributed differently on eyewear device 802 and/or neckband 805. In some embodiments, the components of eyewear device 802 and neckband 805 may be located on one or more additional peripheral devices paired with eyewear device 802, neckband 805, or some combination thereof. Furthermore, Pairing external devices, such as neckband 805, with augmented-reality eyewear devices may enable the eyewear devices to achieve the form factor of a pair of glasses while still providing sufficient battery and computation power for expanded capabilities. Some or all of the battery power, computational resources, and/or additional features of augmented-reality system 800 may be provided by a paired device or shared between a paired device and an eyewear device, thus reducing the weight, heat profile, and form factor of the eyewear device overall while still retaining desired functionality. For example, neckband 805 may allow components that would otherwise be included on an eyewear device to be included in neckband 805 since users may tolerate a heavier weight load on their shoulders than they would tolerate on their heads. Neckband 805 may also have a larger surface area over which to diffuse and disperse heat to the ambient environment. Thus, neckband 805 may allow for greater battery and computation capacity than might otherwise have been possible on a stand-alone eyewear device. Since weight carried in neckband 805 may be less invasive to a user than weight carried in eyewear device 802, a user may tolerate wearing a lighter eyewear device and carrying or wearing the paired device for greater lengths of time than a user would tolerate wearing a heavy standalone eyewear device, thereby enabling users to more fully incorporate artificial reality environments into their day-to-day activities.

Neckband 805 may be communicatively coupled with eyewear device 802 and/or to other devices. These other devices may provide certain functions (e.g., tracking, localizing, depth mapping, processing, storage, etc.) to augmented-reality system 800. In the embodiment of FIG. 8, neckband 805 may include two acoustic transducers (e.g., 820(I) and 820(J)) that are part of the microphone array (or potentially form their own microphone subarray). Neckband 805 may also include a controller 825 and a power source 835.

Acoustic transducers 820(I) and 820(J) of neckband 805 may be configured to detect sound and convert the detected sound into an electronic format (analog or digital). In the embodiment of FIG. 8, acoustic transducers 820(I) and 820(J) may be positioned on neckband 805, thereby increasing the distance between the neckband acoustic transducers 820(I) and 820(J) and other acoustic transducers 820 positioned on eyewear device 802. In some cases, increasing the distance between acoustic transducers 820 of the microphone array may improve the accuracy of beamforming performed via the microphone array. For example, if a sound is detected by acoustic transducers 820(C) and 820(D) and the distance between acoustic transducers 820(C) and 820(D) is greater than, e.g., the distance between acoustic transducers 820(D) and 820(E), the determined source location of the detected sound may be more accurate than if the sound had been detected by acoustic transducers 820(D) and 820(E).

Controller 825 of neckband 805 may process information generated by the sensors on 805 and/or augmented-reality system 800. For example, controller 825 may process information from the microphone array that describes sounds detected by the microphone array. For each detected sound, controller 825 may perform a direction-of-arrival (DOA) estimation to estimate a direction from which the detected sound arrived at the microphone array. As the microphone array detects sounds, controller 825 may populate an audio data set with the information. In embodiments in which augmented-reality system 800 includes an inertial measurement unit, controller 825 may compute all inertial and spatial calculations from the IMU located on eyewear device 802. A connector may convey information between augmented-reality system 800 and neckband 805 and between augmented-reality system 800 and controller 825. The information may be in the form of optical data, electrical data, wireless data, or any other transmittable data form. Moving the processing of information generated by augmented-reality system 800 to neckband 805 may reduce weight and heat in eyewear device 802, making it more comfortable to the user.

Power source 835 in neckband 805 may provide power to eyewear device 802 and/or to neckband 805. Power source 835 may include, without limitation, lithium ion batteries, lithium-polymer batteries, primary lithium batteries, alkaline batteries, or any other form of power storage. In some cases, power source 835 may be a wired power source. Including power source 835 on neckband 805 instead of on eyewear device 802 may help better distribute the weight and heat generated by power source 835.

As noted, some artificial reality systems may, instead of blending an artificial reality with actual reality, substantially replace one or more of a user's sensory perceptions of the real world with a virtual experience. One example of this type of system is a head-worn display system, such as virtual-reality system 900 in FIG. 9, that mostly or completely covers a user's field of view. Virtual-reality system 900 may include a front rigid body 902 and a band 904 shaped to fit around a user's head. Virtual-reality system 900 may also include output audio transducers 906(A) and 906(B). Furthermore, while not shown in FIG. 9, front rigid body 902 may include one or more electronic elements, including one or more electronic displays, one or more inertial measurement units (IMUS), one or more tracking emitters or detectors, and/or any other suitable device or system for creating an artificial reality experience.

Artificial reality systems may include a variety of types of visual feedback mechanisms. For example, display devices in augmented-reality system 900 and/or virtual-reality system 900 may include one or more liquid crystal displays (LCDs), light emitting diode (LED) displays, organic LED (OLED) displays, and/or any other suitable type of display screen. Artificial reality systems may include a single display screen for both eyes or may provide a display screen for each eye, which may allow for additional flexibility for varifocal adjustments or for correcting a user's refractive error. Some artificial reality systems may also include optical subsystems having one or more lenses (e.g., conventional concave or convex lenses, Fresnel lenses, adjustable liquid lenses, etc.) through which a user may view a display screen.

In addition to or instead of using display screens, some artificial reality systems may include one or more projection systems. For example, display devices in augmented-reality system 800 and/or virtual-reality system 900 may include micro-LED projectors that project light (using, e.g., a waveguide) into display devices, such as clear combiner lenses that allow ambient light to pass through. The display devices may refract the projected light toward a user's pupil and may enable a user to simultaneously view both artificial reality content and the real world. Artificial reality systems may also be configured with any other suitable type or form of image projection system.

Artificial reality systems may also include various types of computer vision components and subsystems. For example, augmented-reality system 700, augmented-reality system 800, and/or virtual-reality system 900 may include one or more optical sensors, such as two-dimensional (2D) or three-dimensional (3D) cameras, time-of-flight depth sensors, single-beam or sweeping laser rangefinders, 3D LiDAR sensors, and/or any other suitable type or form of optical sensor. An artificial reality system may process data from one or more of these sensors to identify a location of a user, to map the real world, to provide a user with context about real-world surroundings, and/or to perform a variety of other functions.

Artificial reality systems may also include one or more input and/or output audio transducers. In the examples shown in FIGS. 7 and 9, output audio transducers 708(A), 708(B), 906(A), and 906(B) may include voice coil speakers, ribbon speakers, electrostatic speakers, piezoelectric speakers, bone conduction transducers, cartilage conduction transducers, and/or any other suitable type or form of audio transducer. Similarly, input audio transducers 710 may include condenser microphones, dynamic microphones, ribbon microphones, and/or any other type or form of input transducer. In some embodiments, a single transducer may be used for both audio input and audio output.

Figure 9:
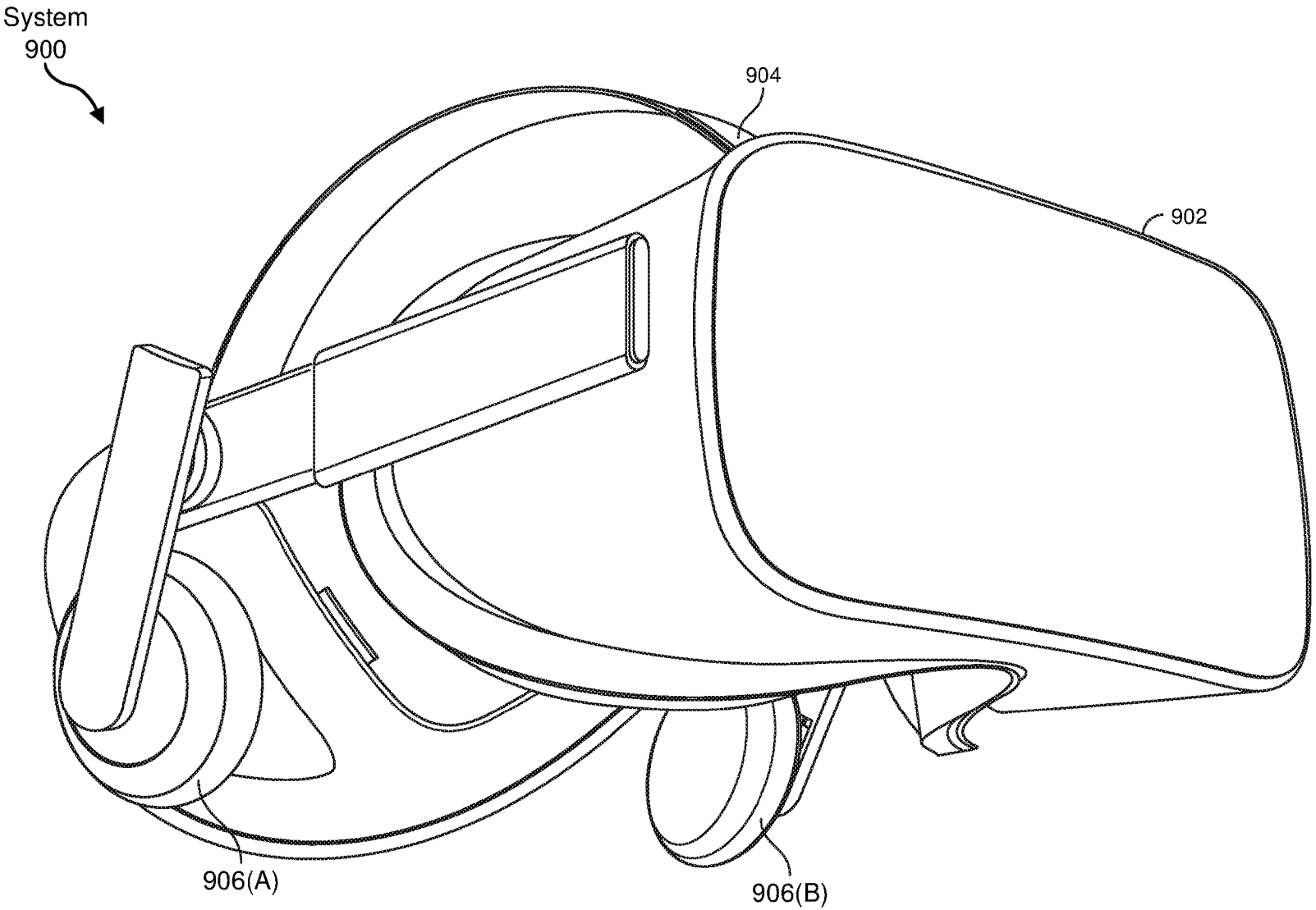
FIG. 9 is an illustration of an exemplary virtual-reality headset that may be used in connection with embodiments of this disclosure.

While not shown in FIGS. 7-9, artificial reality systems may include tactile (i.e., haptic) feedback systems, which may be incorporated into headwear, gloves, body suits, handheld controllers, environmental devices (e.g., chairs, floormats, etc.), and/or any other type of device or system. Haptic feedback systems may provide various types of cutaneous feedback, including vibration, force, traction, texture, and/or temperature. Haptic feedback systems may also provide various types of kinesthetic feedback, such as motion and compliance. Haptic feedback may be implemented using motors, piezoelectric actuators, fluidic systems, and/or a variety of other types of feedback mechanisms. Haptic feedback systems may be implemented independent of other artificial reality devices, within other artificial reality devices, and/or in conjunction with other artificial reality devices.

By providing haptic sensations, audible content, and/or visual content, artificial reality systems may create an entire virtual experience or enhance a user's real-world experience in a variety of contexts and environments. For instance, artificial reality systems may assist or extend a user's perception, memory, or cognition within a particular environment. Some systems may enhance a user's interactions with other people in the real world or may enable more immersive interactions with other people in a virtual world. Artificial reality systems may also be used for educational purposes (e.g., for teaching or training in schools, hospitals, government organizations, military organizations, business enterprises, etc.), entertainment purposes (e.g., for playing video games, listening to music, watching video content, etc.), and/or for accessibility purposes (e.g., as hearing aids, visuals aids, etc.). The embodiments disclosed herein may enable or enhance a user's artificial reality experience in one or more of these contexts and environments and/or in other contexts and environments.

As noted, artificial reality systems 700, 800, and 900 may be used with a variety of other types of devices to provide a more compelling artificial reality experience. These devices may be haptic interfaces with transducers that provide haptic feedback and/or that collect haptic information about a user's interaction with an environment. The artificial-reality systems disclosed herein may include various types of haptic interfaces that detect or convey various types of haptic information, including tactile feedback (e.g., feedback that a user detects via nerves in the skin, which may also be referred to as cutaneous feedback) and/or kinesthetic feedback (e.g., feedback that a user detects via receptors located in muscles, joints, and/or tendons).

Figure 10:
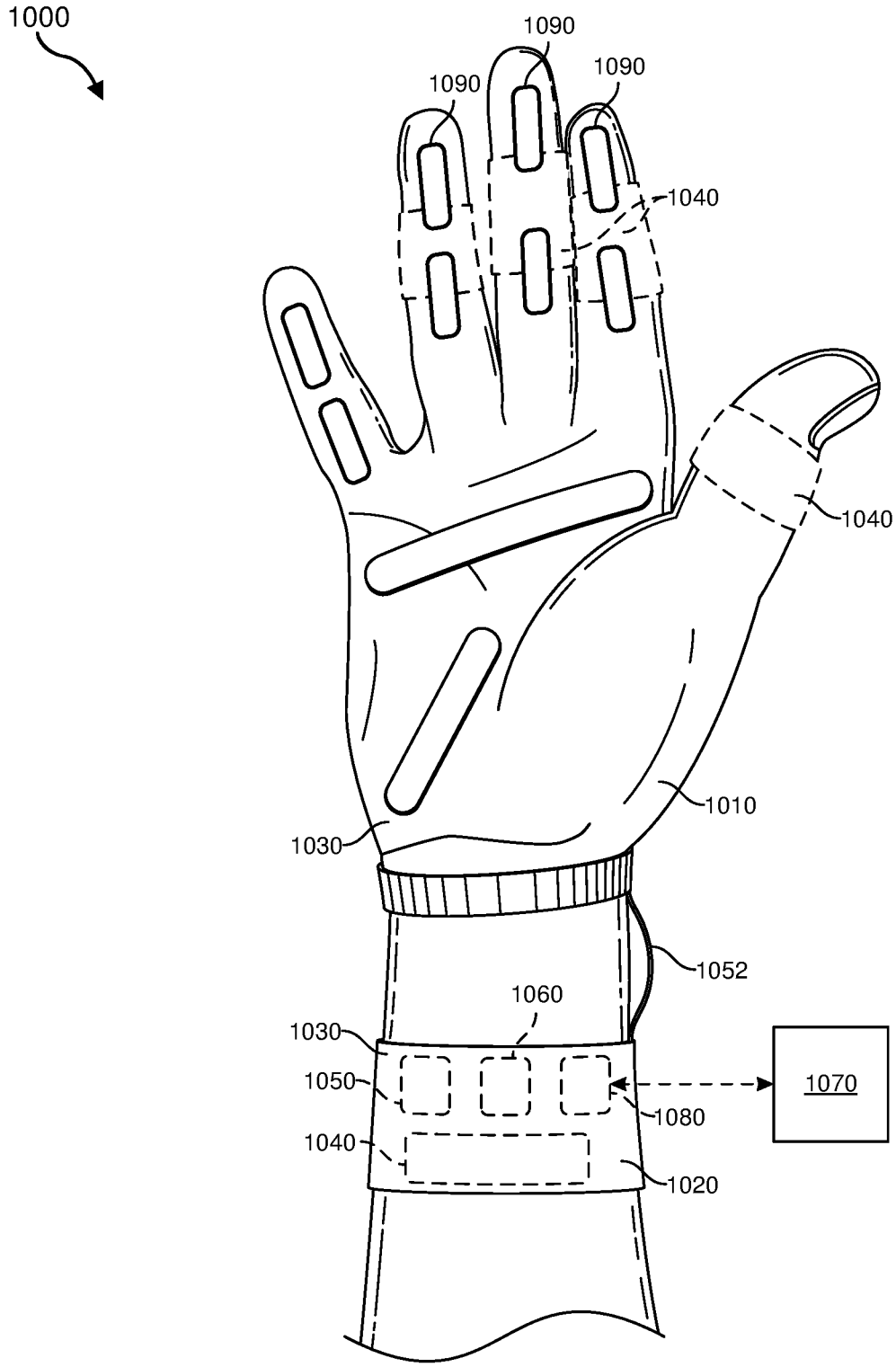
FIG. 10 is an illustration of exemplary haptic devices that may be used in connection with embodiments of this disclosure.

Haptic feedback may be provided by interfaces positioned within a user's environment (e.g., chairs, tables, floors, etc.) and/or interfaces on articles that may be worn or carried by a user (e.g., gloves, wristbands, etc.). As an example, FIG. 10 illustrates a vibrotactile system 1000 in the form of a wearable glove (haptic device 1010) and wristband (haptic device 1020). Haptic device 1010 and haptic device 1020 are shown as examples of wearable devices that include a flexible, wearable textile material 1030 that is shaped and configured for positioning against a user's hand and wrist, respectively. This disclosure also includes vibrotactile systems that may be shaped and configured for positioning against other human body parts, such as a finger, an arm, a head, a torso, a foot, or a leg. By way of example and not limitation, vibrotactile systems according to various embodiments of the present disclosure may also be in the form of a glove, a headband, an armband, a sleeve, a head covering, a sock, a shirt, or pants, among other possibilities. In some examples, the term "textile" may include any flexible, wearable material, including woven fabric, non-woven fabric, leather, cloth, a flexible polymer material, composite materials, etc.

One or more vibrotactile devices 1040 may be positioned at least partially within one or more corresponding pockets formed in textile material 1030 of vibrotactile system 1000. Vibrotactile devices 1040 may be positioned in locations to provide a vibrating sensation (e.g., haptic feedback) to a user of vibrotactile system 1000. For example, vibrotactile devices 1040 may be positioned to be against the user's finger(s), thumb, or wrist, as shown in FIG. 10. Vibrotactile devices 1040 may, in some examples, be sufficiently flexible to conform to or bend with the user's corresponding body part(s).

A power source 1050 (e.g., a battery) for applying a voltage to the vibrotactile devices 1040 for activation thereof may be electrically coupled to vibrotactile devices 1040, such as via conductive wiring 1052. In some examples, each of vibrotactile devices 1040 may be independently electrically coupled to power source 1050 for individual activation. In some embodiments, a processor 1060 may be operatively coupled to power source 1050 and configured (e.g., programmed) to control activation of vibrotactile devices 1040.

Vibrotactile system 1000 may be implemented in a variety of ways. In some examples, vibrotactile system 1000 may be a standalone system with integral subsystems and components for operation independent of other devices and systems. As another example, vibrotactile system 1000 may be configured for interaction with another device or system 1070. For example, vibrotactile system 1000 may, in some examples, include a communications interface 1080 for receiving and/or sending signals to the other device or system 1070. The other device or system 1070 may be a mobile device, a gaming console, an artificial reality (e.g., virtual reality, augmented reality, mixed reality) device, a personal computer, a tablet computer, a network device (e.g., a modem, a router, etc.), a handheld controller, etc. Communications interface 1080 may enable communications between vibrotactile system 1000 and the other device or system 1070 via a wireless (e.g., Wi-Fi, Bluetooth, cellular, radio, etc.) link or a wired link. If present, communications interface 1080 may be in communication with processor 1060, such as to provide a signal to processor 1060 to activate or deactivate one or more of the vibrotactile devices 1040.

Vibrotactile system 1000 may optionally include other subsystems and components, such as touch-sensitive pads 1090, pressure sensors, motion sensors, position sensors, lighting elements, and/or user interface elements (e.g., an on/off button, a vibration control element, etc.). During use, vibrotactile devices 1040 may be configured to be activated for a variety of different reasons, such as in response to the user's interaction with user interface elements, a signal from the motion or position sensors, a signal from the touch-sensitive pads 1090, a signal from the pressure sensors, a signal from the other device or system 1070, etc.

Although power source 1050, processor 1060, and communications interface 1080 are illustrated in FIG. 10 as being positioned in haptic device 1020, the present disclosure is not so limited. For example, one or more of power source 1050, processor 1060, or communications interface 1080 may be positioned within haptic device 1010 or within another wearable textile.

Figure 11:
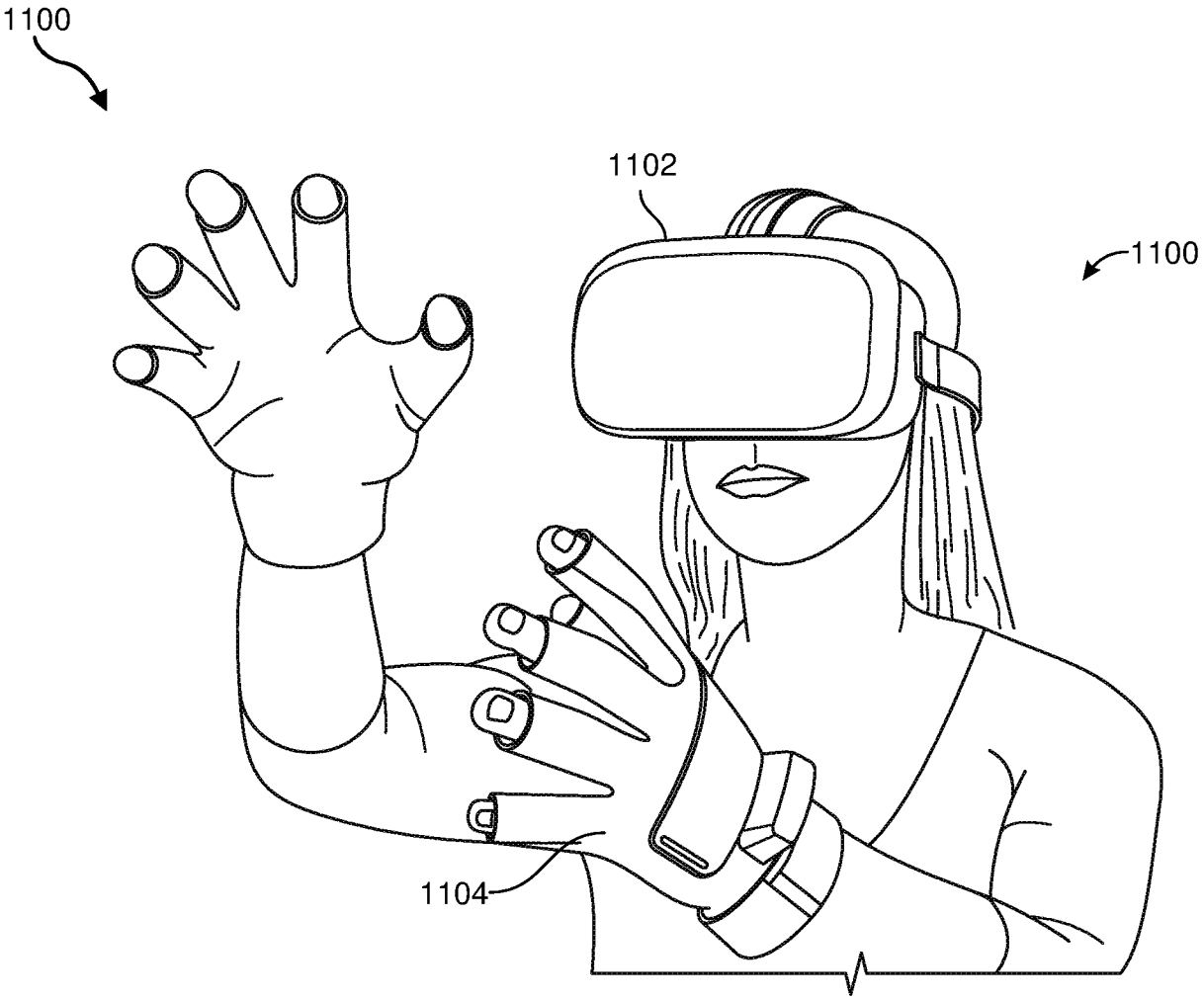
FIG. 11 is an illustration of an exemplary virtual-reality environment according to embodiments of this disclosure.

Haptic wearables, such as those shown in and described in connection with FIG. 10, may be implemented in a variety of types of artificial-reality systems and environments. FIG. 11 shows an example artificial reality environment 1100 including one head-mounted virtual-reality display and two haptic devices (i.e., gloves), and in other embodiments any number and/or combination of these components and other components may be included in an artificial reality system. For example, in some embodiments there may be multiple head-mounted displays each having an associated haptic device, with each head-mounted display and each haptic device communicating with the same console, portable computing device, or other computing system.

Head-mounted display 1102 generally represents any type or form of virtual-reality system, such as virtual-reality system 900 in FIG. 9. Haptic device 1104 generally represents any type or form of wearable device, worn by a use of an artificial reality system, that provides haptic feedback to the user to give the user the perception that he or she is physically engaging with a virtual object. In some embodiments, haptic device 1104 may provide haptic feedback by applying vibration, motion, and/or force to the user. For example, haptic device 1104 may limit or augment a user's movement. To give a specific example, haptic device 1104 may limit a user's hand from moving forward so that the user has the perception that his or her hand has come in physical contact with a virtual wall. In this specific example, one or more actuators within the haptic advice may achieve the physical-movement restriction by pumping fluid into an inflatable bladder of the haptic device. In some examples, a user may also use haptic device 1104 to send action requests to a console. Examples of action requests include, without limitation, requests to start an application and/or end the application and/or requests to perform a particular action within the application.

Figure 12:
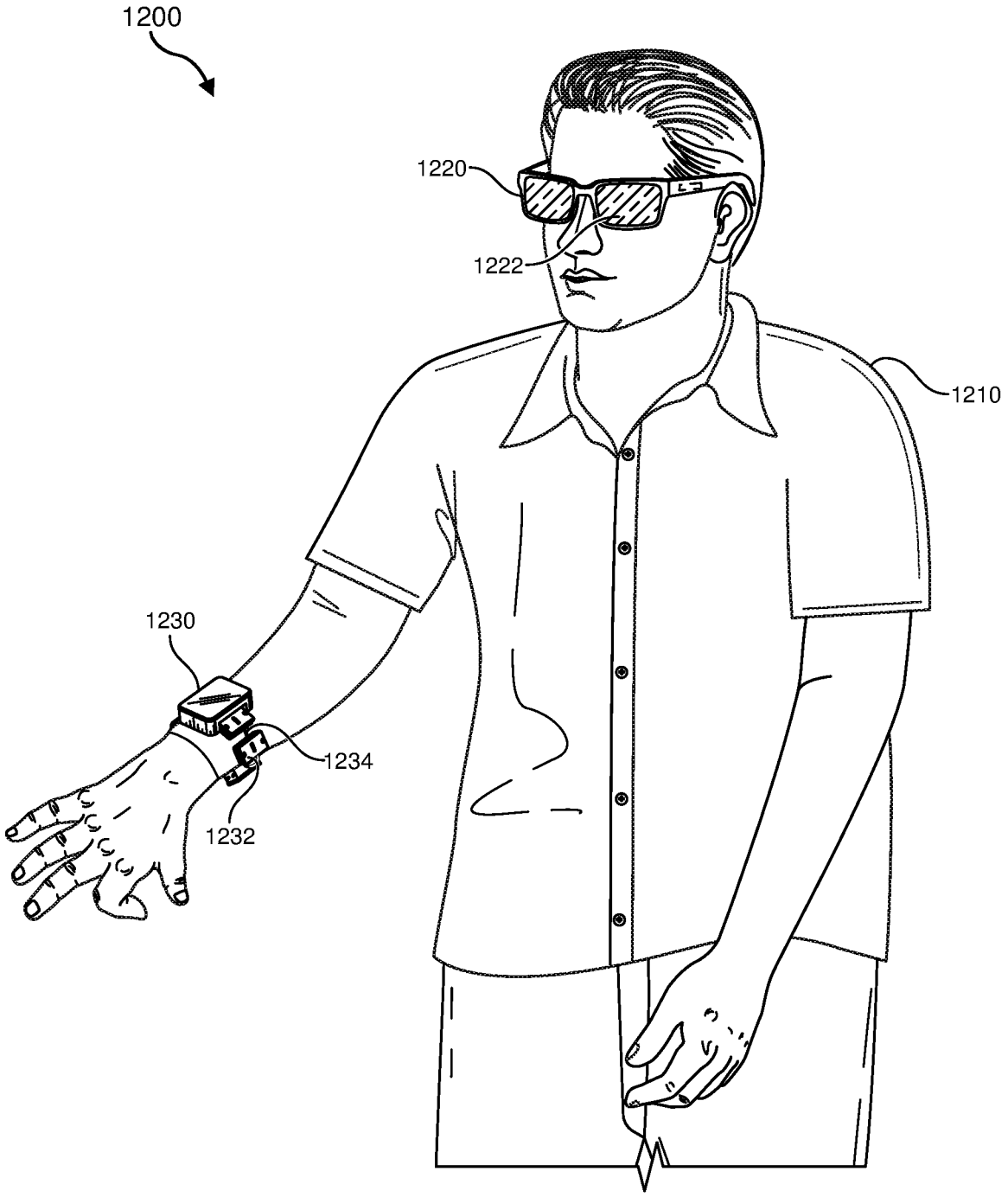
FIG. 12 is an illustration of an exemplary augmented-reality environment according to embodiments of this disclosure Throughout the drawings, identical reference characters and descriptions indicate similar, but not necessarily identical, elements. While the exemplary embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the present disclosure covers all modifications, equivalents, and alternatives falling within the scope of the appended claims.

While haptic interfaces may be used with virtual-reality systems, as shown in FIG. 11, haptic interfaces may also be used with augmented-reality systems, as shown in FIG. 12. FIG. 12 is a perspective view a user 1210 interacting with an augmented-reality system 1200. In this example, user 1210 may wear a pair of augmented-reality glasses 1220 that have one or more displays 1222 and that are paired with a haptic device 1230. Haptic device 1230 may be a wristband that includes a plurality of band elements 1232 and a tensioning mechanism 1234 that connects band elements 1232 to one another.

One or more of band elements 1232 may include any type or form of actuator suitable for providing haptic feedback. For example, one or more of band elements 1232 may be configured to provide one or more of various types of cutaneous feedback, including vibration, force, traction, texture, and/or temperature. To provide such feedback, band elements 1232 may include one or more of various types of actuators. In one example, each of band elements 1232 may include a vibrotactor (e.g., a vibrotactile actuator) configured to vibrate in unison or independently to provide one or more of various types of haptic sensations to a user. Alternatively, only a single band element or a subset of band elements may include vibrotactors.

Haptic devices 1010, 1020, 1104, and 1230 may include any suitable number and/or type of haptic transducer, sensor, and/or feedback mechanism. For example, haptic devices 1010, 1020, 1104, and 1230 may include one or more mechanical transducers, piezoelectric transducers, and/or fluidic transducers. Haptic devices 1010, 1020, 1104, and 1230 may also include various combinations of different types and forms of transducers that work together or independently to enhance a user's artificial-reality experience. In one example, each of band elements 1232 of haptic device 1230 may include a vibrotactor (e.g., a vibrotactile actuator) configured to vibrate in unison or independently to provide one or more of various types of haptic sensations to a user.

As detailed above, the computing devices and systems described and/or illustrated herein broadly represent any type or form of computing device or system capable of executing computer-readable instructions, such as those contained within the modules described herein. In their most basic configuration, these computing device(s) may each include at least one memory device and at least one physical processor.

In some examples, the term "memory device" generally refers to any type or form of volatile or non-volatile storage device or medium capable of storing data and/or computer-readable instructions. In one example, a memory device may store, load, and/or maintain one or more of the modules described herein. Examples of memory devices include, without limitation, Random Access Memory (RAM), Read Only Memory (ROM), flash memory, Hard Disk Drives (HDDs), Solid-State Drives (SSDs), optical disk drives, caches, variations or combinations of one or more of the same, or any other suitable storage memory.

In some examples, the term "physical processor" generally refers to any type or form of hardware-implemented processing unit capable of interpreting and/or executing computer-readable instructions. In one example, a physical processor may access and/or modify one or more modules stored in the above-described memory device. Examples of physical processors include, without limitation, microprocessors, microcontrollers, Central Processing Units (CPUs), Field-Programmable Gate Arrays (FPGAs) that implement softcore processors, Application-Specific Integrated Circuits (ASICs), portions of one or more of the same, variations or combinations of one or more of the same, or any other suitable physical processor.

Although illustrated as separate elements, the modules described and/or illustrated herein may represent portions of a single module or application. In addition, in certain embodiments one or more of these modules may represent one or more software applications or programs that, when executed by a computing device, may cause the computing device to perform one or more tasks. For example, one or more of the modules described and/or illustrated herein may represent modules stored and configured to run on one or more of the computing devices or systems described and/or illustrated herein. One or more of these modules may also represent all or portions of one or more special-purpose computers configured to perform one or more tasks.

In addition, one or more of the modules described herein may transform data, physical devices, and/or representations of physical devices from one form to another. For example, one or more of the modules recited herein may receive data to be transformed, transform the data, output a result of the transformation to generate a drive signal for a display, use the result of the transformation to drive the display, and store the result of the transformation for future frames. Additionally or alternatively, one or more of the modules recited herein may transform a processor, volatile memory, non-volatile memory, and/or any other portion of a physical computing device from one form to another by executing on the computing device, storing data on the computing device, and/or otherwise interacting with the computing device.

In some embodiments, the term "computer-readable medium" generally refers to any form of device, carrier, or medium capable of storing or carrying computer-readable instructions. Examples of computer-readable media include, without limitation, transmission-type media, such as carrier waves, and non-transitory-type media, such as magnetic-storage media (e.g., hard disk drives, tape drives, and floppy disks), optical-storage media (e.g., Compact Disks (CDs), Digital Video Disks (DVDs), and BLU-RAY disks), electronic-storage media (e.g., solid-state drives and flash media), and other distribution systems.

The process parameters and sequence of the steps described and/or illustrated herein are given by way of example only and can be varied as desired. For example, while the steps illustrated and/or described herein may be shown or discussed in a particular order, these steps do not necessarily need to be performed in the order illustrated or discussed. The various exemplary methods described and/or illustrated herein may also omit one or more of the steps described or illustrated herein or include additional steps in addition to those disclosed.

The preceding description has been provided to enable others skilled in the art to best utilize various aspects of the exemplary embodiments disclosed herein. This exemplary description is not intended to be exhaustive or to be limited to any precise form disclosed. Many modifications and variations are possible without departing from the spirit and scope of the present disclosure. The embodiments disclosed herein should be considered in all respects illustrative and not restrictive. Reference should be made to the appended claims and their equivalents in determining the scope of the present disclosure.

Unless otherwise noted, the terms "connected to" and "coupled to" (and their derivatives), as used in the specification and claims, are to be construed as permitting both direct and indirect (i.e., via other elements or components) connection. In addition, the terms "a" or "an," as used in the specification and claims, are to be construed as meaning "at least one of." Finally, for ease of use, the terms "including" and "having" (and their derivatives), as used in the specification and claims, are interchangeable with and have the same meaning as the word "comprising."

What is claimed is:

1. A computer-implemented method comprising:

determining a frame rate for a current frame, the frame rate dictating the amount of time the current frame is to be presented on a display, the display including a backlight that is powered for a specified amount of time as part of a duty cycle;

receiving one or more sensor inputs from sensors associated with the display;

calculating a backlight duty cycle time for the current frame according to a specified persistence mode, the backlight duty cycle time comprising a specified minimum amount of powered time plus an additional amount of powered time that is dependent on the frame rate for the current frame, wherein the specified persistence mode is selected based on the sensor inputs received at the sensors associated with the display;

generating a drive signal for the display using the calculated backlight duty cycle time; and driving the display using the generated drive signal, such that the backlight of the display is powered for the calculated backlight duty cycle time during the current frame.

2. The computer-implemented method of claim 1, wherein the current frame is part of a portion of media content having a plurality of video frames.

3. The computer-implemented method of claim 1, wherein the backlight duty cycle times are calculated dynamically for each frame.

4. The computer-implemented method of claim 3, wherein the frame rate changes during a portion of media content, and wherein the dynamic calculation changes for the different frame rate.

5. The computer-implemented method of claim 1, wherein the backlight duty cycle times are pre-calculated for a plurality of different frame rates.

6. The computer-implemented method of claim 1, wherein the amount of time the backlight is powered on is proportionate to a total time the current frame is displayed.

7. The computer-implemented method of claim 6, wherein the amount of time the backlight is powered on is longer for lower frame rates and is shorter for higher frame rates.

8. The computer-implemented method of claim 1, wherein the display comprises a liquid crystal display (LCD) and wherein the backlight comprises a cold cathode fluorescent (CCFL) backlight.

9. The computer-implemented method of claim 1, wherein the display comprises an LCD and wherein the backlight comprises a light emitting diode (LED) backlight.

10. The computer-implemented method of claim 1, wherein the display comprises a low-persistence display.

11. The computer-implemented method of claim 10, wherein the low-persistence display is part of an artificial reality device.

12. A system comprising:

at least one physical processor;

physical memory comprising computer-executable instructions that, when executed by the physical processor, cause the physical processor to:

determine a frame rate for a current frame, the frame rate dictating the amount of time the current frame is to be presented on a display, the display including a backlight that is powered for a specified amount of time as part of a duty cycle;

receive one or more sensor inputs from sensors associated with the display;

calculate a backlight duty cycle time for the current frame according to a specified persistence mode, the backlight duty cycle time comprising a specified minimum amount of powered time plus an additional amount of powered time that is dependent on the frame rate for the current frame, wherein the specified persistence mode is selected based on the sensor inputs received at the sensors associated with the display;

generate a drive signal for the display using the calculated backlight duty cycle time; and drive the display using the generated drive signal, such that the backlight of the display is powered for the calculated backlight duty cycle time during the current frame.

13. The system of claim 12, wherein the backlight is operated according to a specified persistence mode.

14. The system of claim 13, wherein the display refresh rate is synchronized according to the backlight persistence mode.

15. The system of claim 13, wherein the display refresh rate is synchronized according to the backlight persistence mode and is further synchronized with a graphics processing unit (GPU) frame rate associated with a GPU that generates the current frame.

16. The system of claim 12, wherein the backlight duty cycle times are pre-calculated for a plurality of different display refresh rates.

17. The system of claim 16, wherein the pre-calculated backlight duty cycle times are stored in a lookup table.

18. The system of claim 17, wherein the lookup table is consulted for each current frame to determine the appropriate backlight duty cycle time for that frame.

19. The system of claim 18, wherein the drive signal for the display is generated based on the pre-calculated backlight duty cycle times.

20. A non-transitory computer-readable medium comprising one or more computer-executable instructions that, when executed by at least one processor of a computing device, cause the computing device to:

determine a frame rate for a current frame, the frame rate dictating the amount of time the current frame is to be presented on a display, the display including a backlight that is powered for a specified amount of time as part of a duty cycle;

receive one or more sensor inputs from sensors associated with the display;

calculate a backlight duty cycle time for the current frame according to a specified persistence mode, the backlight duty cycle time comprising a specified minimum amount of powered time plus an additional amount of powered time that is dependent on the frame rate for the current frame, wherein the specified persistence mode is selected based on the sensor inputs received at the sensors associated with the display;

generate a drive signal for the display using the calculated backlight duty cycle time; and drive the display using the generated drive signal, such that the backlight of the display is powered for the calculated backlight duty cycle time during the current frame.

* * * * *